US011027945B2

(12) United States Patent
Buetler

(10) Patent No.: US 11,027,945 B2
(45) Date of Patent: Jun. 8, 2021

(54) WALL SECURING ASSEMBLY FOR SECURING AN ELEVATOR COMPONENT

(71) Applicant: Inventio AG, Hergiswil (CH)

(72) Inventor: Erich Buetler, Ebikon (CH)

(73) Assignee: INVENTIO AG, Hergiswil NW (CH)

( * ) Notice: Subject to any disclaimer, the term of this patent is extended or adjusted under 35 U.S.C. 154(b) by 272 days.

(21) Appl. No.: 16/326,730

(22) PCT Filed: Sep. 4, 2017

(86) PCT No.: PCT/EP2017/072100
§ 371 (c)(1),
(2) Date: Feb. 20, 2019

(87) PCT Pub. No.: WO2018/050469
PCT Pub. Date: Mar. 22, 2018

(65) Prior Publication Data

US 2019/0210839 A1 Jul. 11, 2019

(30) Foreign Application Priority Data

Sep. 13, 2016 (EP) ..... 16188561

(51) Int. Cl.
*B66B 11/00* (2006.01)
*B66B 19/00* (2006.01)
(Continued)

(52) U.S. Cl.
CPC ..... *B66B 11/0005* (2013.01); *B66B 7/024* (2013.01); *B66B 19/002* (2013.01); *E04B 1/4107* (2013.01)

(58) Field of Classification Search
CPC ..... E04B 1/4107; E04B 1/41; B66B 11/0005; B66B 7/024; B66B 10/002
See application file for complete search history.

(56) References Cited

U.S. PATENT DOCUMENTS 2,463,215 A * 3/1949 Strachan ..... B66B 7/02 187/408
3,991,528 A * 11/1976 Dillon ..... E04B 1/34823 52/79.9
(Continued)

FOREIGN PATENT DOCUMENTS

CH 618779 A5 8/1980
CN 2773211 Y 4/2006
(Continued)

*Primary Examiner* — Michael A Riegelman
(74) *Attorney, Agent, or Firm* — William J. Clemens; Shumaker, Loop & Kendrick, LLP

(57) ABSTRACT

A wall securing assembly is integrated into an elevator shaft wall for securing a guide rail to the wall. The wall has a first concrete region that is reinforced with reinforcements and a second concrete region that is not reinforced. The second region covers the first region and has a surface that is exposed to the surroundings. The securing assembly has an elongated profile of C-shaped cross-section embedded solely into the second region and oriented in the vertical direction of the wall. Since tensile forces acting on a guide rail in an elevator shaft are very low, it is acceptable to secure the guide rail to the profile that is cast into the second region covering the reinforcement. The profile is anchor element-free and can be arranged in the wall vertically whereby guide rail holding consoles can be secured to the profile at any height.

17 Claims, 4 Drawing Sheets

(51) Int. Cl.
*E04B 1/41* (2006.01)
*B66B 7/02* (2006.01)

(56) References Cited

U.S. PATENT DOCUMENTS

| | | | | |
|---|---|---|---|---|
| 4,365,744 | A * | 12/1982 | Moehren | E01B 9/64 238/299 |
| 5,623,804 | A * | 4/1997 | Kelly | E04B 1/4107 52/704 |
| 7,654,057 | B2 * | 2/2010 | Zambelli | E04B 1/4107 52/710 |
| 8,635,832 | B2 * | 1/2014 | Heudorfer | E04B 1/4107 52/704 |
| 2003/0217521 | A1 * | 11/2003 | Richardson | E04B 7/045 52/92.2 |
| 2011/0094183 | A1 * | 4/2011 | Gasperi | E04B 2/94 52/705 |
| 2011/0283654 | A1 * | 11/2011 | Pol | C23C 2/06 52/710 |
| 2012/0060435 | A1 * | 3/2012 | Heudorfer | E04B 1/4107 52/181 |
| 2012/0167517 | A1 * | 7/2012 | Ruiz | E04B 1/41 52/582.1 |
| 2014/0208678 | A1 * | 7/2014 | Yau | E04C 5/166 52/699 |
| 2016/0305115 | A1 * | 10/2016 | Albartus | E04B 1/4107 |
| 2019/0210839 | A1 * | 7/2019 | Buetler | B66B 7/024 |

FOREIGN PATENT DOCUMENTS

| | | | |
|---|---|---|---|
| CN | 202017262 | U | 10/2011 |
| CN | 102859089 | A | 1/2013 |
| CN | 104340813 | A | 2/2015 |
| DE | 2651566 | A1 | 5/1978 |
| EP | 0436165 | A2 | 7/1991 |
| GB | 231702 | A | 4/1925 |

* cited by examiner

WALL SECURING ASSEMBLY FOR SECURING AN ELEVATOR COMPONENT

FIELD

The present invention relates to a wall securing assembly by means of which an elevator component, such as a guide rail, can be secured to an elevator shaft wall. The invention further relates to a method for producing a wall securing assembly of this kind, and to a use of a profile that is C-shaped in cross section as a component of the wall securing assembly.

BACKGROUND

When constructing structures and buildings, walls are today in many cases produced using concrete. In this context, the term "wall" is intended to be interpreted broadly and to comprise for example any supporting construction provided with an exposed surface on a structure.

In order to be able to provide a wall with a required degree of stability, in particular also in the case of tensile loads, reinforcements, sometimes also referred to as armoring, are incorporated into the concrete. Struts, webs or other constructions consisting of material that is highly loadable under tension, for example steel, are often inserted, as reinforcements, into a volume that is later to be grouted using liquid concrete. In this case, a geometry, arrangement and dimensioning of the reinforcements is generally selected taking account of the loads that are anticipated to later act on the wall.

It is often intended that it should be possible to subsequently secure further components to the finished wall. For example, it is intended that it should be possible to hold additional components on the wall in a stationary manner, such that forces acting on the additional components are introduced into the wall.

As an example for a wall, a wall of an elevator shaft will usually be described in the following, which wall defines an elevator shaft volume. It is intended that it should be possible for displaceable elevator components, such as an elevator car or a counterweight, to be displaced within the elevator shaft volume. In this case, it is intended for the displaceable elevator components to be guided for example by means of stationary elevator components that are secured to the elevator shaft wall, for example guide rails. In this case, the stationary elevator components are intended to be secured to the elevator shaft wall such that in particular compression forces and thrust, as are exerted when the displaceable elevator components are guided on the stationary elevator components, can be conducted away into the elevator shaft wall, via the securing means. An example for securing guide rails is described in EP 0 585 684 A1.

A plurality of methods is generally available for this purpose. For example, it is possible to retrospectively drill holes in the finished concrete wall of an elevator shaft, in which holes anchor components, such as screws or bolts, with or without a wall plug, can then be anchored. However, for this purpose it is necessary to retrospectively drill a plurality of holes in the very hard concrete, which is associated with significant effort. Furthermore, problems arise when drilling the holes if the reinforcement received in the concrete is encountered in the process. Moreover, significant amounts of dust may result when drilling the holes, which may pose a risk both for personnel and for tools.

Alternatively, suitable means (denoted in the following as wall securing assemblies) may be arranged at desired positions within the volume to be grouted, before the concrete wall is cast, such that said wall securing assemblies can subsequently be integrally cast into the concrete and appropriate securing means can later be secured to said wall securing assemblies. For example, profiles may be cast into the concrete wall as wall securing assemblies, and securing means may subsequently be anchored in said profiles. Profiles of this kind are also referred to as anchor profiles. When constructing elevators, for this purpose profiles mostly extending in the horizontal direction are conventionally secured to the reinforcement to be received in the profile concrete prior to casting the concrete, and are then integrally cast therewith. As a result, retrospective drilling into the concrete is not required, but instead, provided that the profiles have been previously cast in in a manner correctly positioned in the wall, additional components can be quickly and easily secured to the profiles having a horizontal orientation. When the profiles are oriented horizontally, tensile forces that act on the securing means anchored to the profiles are introduced better into the concrete wall. However, it has often been found to be difficult, in practice, to cast in profiles in an accurately positioned manner. Moreover, it may be necessary for positions in the elevator shaft of a building, at which positions the wall securing assemblies are intended to be integrated into the elevator shaft wall, to already be precisely defined prior to constructing said building, and this may be associated with significant planning and coordination effort. Significant post-processing outlay may result in the event of cast profiles not being correctly positioned.

It is also possible to concrete in metal plates that function as wall securing assemblies, and to subsequently attach, for example weld on, securing means to the cast metal plates. In this case, too, retrospective drilling of holes in the hardened concrete can be omitted. However, in this case too, similarly to the case for the cast profiles described above, it may be difficult to find the cast metal plates again in the finished hardened concrete. Moreover, welding work to be carried out may be laborious and may be able to be completed only by specialists. In addition, since it is necessary for the metal plates to already be provided before the elevator shaft is constructed and for the position thereof to be precisely defined, significant planning and coordination effort may also be required in this case.

There may be a need inter alia for a wall of a structure, in particular an elevator shaft wall, in which or in the production of which the above-mentioned disadvantages can be prevented at least in part. In particular, there may be a need for a wall and a method for the production thereof, in which the additional components, such as stationary elevator components, can be secured to the wall in a simple and sufficiently stable manner and/or in a manner requiring little outlay for work and/or costs, and/or the wall can be produced in a simple and sufficiently stable manner and/or in a manner requiring little outlay for work and/or costs.

SUMMARY

According to an aspect of the invention, a wall securing assembly for securing an elevator component, in particular a guide rail, to an elevator shaft wall, is proposed. The wall securing assembly comprises a first concrete region of the elevator shaft wall which is strengthened with reinforcements, and a second concrete region of the elevator shaft wall which is not reinforced with reinforcements, covers the first concrete region, and comprises a surface that is exposed to the surroundings. The wall securing assembly furthermore has an elongated profile which is C-shaped in cross-section. In this case, the profile is embedded solely in the second concrete region and is oriented in a main extension direction of the elevator shaft.

According to a second aspect of the invention, a method for producing a wall securing assembly for securing an elevator component, in particular a guide rail, to an elevator shaft wall, is proposed. The method comprises at least the following steps, possibly, but not necessarily, in the specified order: firstly, a reinforcement is formed in a first concrete region of the elevator shaft wall. The first concrete region is delimited or faced with cladding such that a second concrete region without a reinforcement located therein remains between the reinforcement and the cladding, the second concrete region also being part of the elevator shaft wall. An elongated profile which is C-shaped in cross-section is arranged in a main extension direction of the elevator shaft, solely within the second concrete region. Finally, the first and the second concrete region are grouted in concrete.

According to a third aspect of the invention, a use of a profile that is C-shaped in cross-section as a wall securing assembly in a wall according to an embodiment of the above first aspect is proposed.

Possible features and advantages of embodiments of the invention can be considered, inter alia and without limiting the invention, as being based on the concepts and findings described in the following.

As briefly described in the introduction, various approaches are used in particular in elevator construction in order to fix additional components to walls of an elevator shaft. However, said approaches are either very laborious, such as in the case of screwing the additional components into previously drilled holes in the concrete wall, or require early planning that is adjusted individually to a specific construction project in order to for example already cast anchor profiles or steel plates at suitable positions in the concrete wall during the production thereof.

In order inter alia to prevent the problems mentioned, it is proposed to integrate just one, or at least only a few, planar C-shaped profiles into the concrete wall, in a main extension direction of the elevator shaft, as part of the wall securing assembly, instead of attaching a plurality of individual anchor profiles in the elevator shaft wall, which anchor profiles extend horizontally while the main extension direction of the elevator shaft is usually vertical. The main extension direction of the elevator shaft corresponds to the displacement direction of the elevator car that is displaceably arranged in the elevator shaft, and in particular the orientation of the guide rails that are oriented in the elevator shaft. Said main extension direction of the elevator shaft preferably extends vertically.

In this context, a C-shaped profile is intended to be understood to be an elongated body that has a C-shaped cross-section. A C-shaped profile is sometimes also referred to as a C-rail. The C-shaped profile surrounds an internal volume, and in the process is closed on one side and open on an opposing side via a generally continuous slot or a through-opening. However, in contrast to a U-shaped profile, the C-shaped profile also covers the internal volume on the side provided with the opening, at least in part. Via the opening, a securing element, for example, can engage in the internal volume of the profile and be anchored there. In this case, the securing element may for example engage behind flanks that cover the internal volume adjacently to the opening at least in part. In the case of the wall proposed here, the opening may be arranged so as to be adjacent to the exposed surface of said wall.

The wall securing assembly proposed herein is intended to differ from a wall securing assembly comprising conventional anchor profiles at least with respect to two features:

Firstly, the C-shaped profile(s) is/are intended to be arranged solely in the second concrete region, i.e. in the region of the elevator shaft wall in which no reinforcements are provided.

This distinguishes the C-shaped profiles proposed herein from conventional anchor profiles which generally always extend as far as into the first concrete region that is provided with reinforcements. In this case, in conventional anchor profiles, anchor projections are usually formed on a rear face, which anchor projections are intended to reach between the reinforcements and optionally engage therebehind in order to anchor the anchor profiles in the concrete wall so as to be highly loadable, even under tension. In contrast thereto, the C-shaped profiles described here are not intended to reach as far as into the first concrete region, but to instead be located only within the second concrete region.

This is based inter alia on the finding that conventional anchor profiles were usually developed for applications in which high tensile loads are intended to be conducted away into a wall. Since it is known that concrete can withstand high pressures of often more than 2 kN/cm$^2$ without problem but under tension can usually be loaded only with approximately a tenth of such forces, in this case it is necessary to ensure that the tensile forces to be introduced can be transmitted to the reinforcement of the concrete. For this purpose, the anchor projections of the anchor profiles usually reach relatively deep into the wall.

However, there are no high tensile forces acting on the elevator shaft wall. Securing guide rails of an elevator system to elevator shaft walls may result in significant compression forces or thrust on the wall or on additional components attached thereto. However, tensile forces that arise in the process are usually low, i.e. usually below 10 kN, often below 2 kN. It is therefore considered to be sufficient, for specific applications of this kind, to receive a C-shaped profile, as a component of the wall securing assembly, only in the second concrete region that does not have a reinforcement. Said second concrete region covers the first concrete region, strengthened by reinforcements, only close to the surface, often at a thickness of only a few centimeters, and is intended inter alia to prevent the reinforcements coming into contact with water or other corrosive media.

Secondly, unlike conventional anchor profiles, the C-shaped profile(s) is/are not intended to be cast into the concrete wall so as to be oriented horizontally. Instead, said profiles are intended to be received in the elevator shaft wall in the main extension direction of the elevator shaft wall, that is to say preferably in the vertical direction, i.e. from top to bottom.

In this case, conventional anchor profiles have hitherto been oriented horizontally, since the anchor projections thereof would otherwise in many cases have prevented precise positioning owing to conflicts or collisions with the numerous and often complexly arranged reinforcements within the first concrete region.

The fact that, in the case of the wall described here, engagement of the C-shaped profiles in the first concrete region is intentionally omitted, allows for the possibility of said profiles also being able to be arranged in the elevator shaft wall in a preferably vertical orientation. For example, a planar C-shaped profile pushed into any position, adjacently to a previously arranged reinforcement, and fixed there. In particular, a planar profile of this kind can also still be arranged retrospectively, for example after a cladding has already been attached adjacently to the reinforcement, which cladding is subsequently intended to be grouted in concrete. In this case, the planar profile can be inserted between the gap between the reinforcements, which gap later forms the second concrete region, and a cladding that is spaced apart therefrom.

In this context, it is considered to be advantageous if, according to one embodiment, the profile has a depth, measured in a direction orthogonal to the exposed surface of the second concrete region, of at most 30 mm, preferably at most 25 mm. This takes account of the fact that, in concrete engineering, a superficially covering second concrete layer that covers a first concrete layer that is located therebelow and is strengthened by reinforcements, is typically formed having a layer thickness of at least 25 mm, usually at least 30 mm. Since the C-shaped profile is designed having a corresponding planar structure of a small depth, said profile can be received in the covering concrete layer without problem, and without protruding either into the reinforced first concrete layer or beyond the exposed surface of the second concrete layer.

The orientation, made possible thereby, of the profile in the vertical direction or in the extension direction of the elevator shaft allows for some significant advantages.

For example, additional components can be attached to the profile, oriented in the extension direction of the elevator shaft, at any height within the structure. In contrast thereto, in conventional, substantially horizontally oriented, anchor profiles, the positions, in particular the heights, at which the structural components are intended to be arranged had to be determined very precisely and even before casting a concrete wall. This could be associated with problems, in particular in elevator engineering, since individual anchor profiles could not easily be arranged and oriented relative to specified nearby structures in the elevator shaft, such as adjacent walls, but instead often only relative to other anchor profiles. For example, it could be intended to provide horizontally extending anchor profiles at regular spacings in a vertical direction within an elevator shaft, deviations in the precise positioning of the anchor profiles being possible, however, owing for example to position overlaps with other components or due to construction-related tolerances. This could result inter alia in additional components ultimately not being able to be mounted at desired heights, or being able to be mounted there only with additional effort.

It could furthermore be the case that horizontally arranged anchor components were covered by concrete or concrete water during casting of the concrete, and were then difficult to find in the hardened concrete, and sometimes had to be chiseled out, owing to the position thereof not being precisely known. In contrast thereto, vertically arranged C-shaped profiles can be arranged for example at a consistent height and/or a precisely specified spacing relative to nearby structures within the elevator shaft, for example in parallel with an edge between two mutually adjacent side walls. Owing to a known, precise positioning of this kind, profiles of this kind can be easily found again, even in the event of being covered by concrete during casting.

According to an embodiment, the C-shaped profile does not comprise any rigid anchor elements that protrude in a direction away from a rear surface of the profile.

In other words, in contrast with conventional anchor profiles, no rigid anchor projections are intended to be provided on the profile that is to be received in the second concrete region, which anchor projections protrude backwards as far as the first concrete region located therebelow. Instead, the C-shaped profile may for example be substantially smooth, in particular substantially planar, on the rear face thereof. In this case, a rigid anchor element can be understood to be a protruding projection that is not significantly resiliently bendable, i.e. for example a solid metal projection in the form of a bolt, hook or the like. As explained above, the lack of a rigid anchor element of this kind can make it possible for the C-shaped profile to be positioned at any point adjacently to the exposed surface of the wall, without the possibility of position overlaps with the reinforcement that is located deeper in the interior.

According to an embodiment, the profile is received in the second concrete region in an interlockingly undercut manner.

In this case, "interlockingly undercut" can be understood to mean that at least portions of the C-profile are covered by concrete, and the C-profile therefore cannot be pulled out of the concrete wall towards the exposed surface thereof without causing local damage to the covering concrete layer.

In particular, the C-profile is intended to be designed such it has a greater width further towards the inside, i.e. remote from the exposed surface and thus remote from the opening of said profile, than close to the exposed surface. As a result, concrete can locally cover the C-profile in the narrower region thereof close to the surface, and thus bring about the desired undercut. The width of the C-profile further towards the inside and the width of the C-profile close to the exposed surface may differ relatively for example by at least 10%, preferably at least 30%, or even at least 50%. For example, the cross-section of the C-profile may widen conically or in a stepped manner, away from the exposed surface.

In particular, according to an embodiment, at least one flank of the profile that is oriented towards the exposed surface of the second concrete region may be arranged so as to be inclined relative to the exposed surface.

In other words, it may be advantageous for an outwardly oriented surface of the C-profile, i.e. a surface of the C-profile that is oriented towards the exposed surface of the wall, not to extend in parallel with the exposed surface but instead to extend so as to be inclined relative thereto. In particular, it may be advantageous for the surface of the C-profile to extend obliquely backwards towards the first concrete region, directly adjacently to the opening of said C-profile, i.e. not to extend in parallel with the exposed surface of the wall, and for the cross-section of the C-profile to thus widen conically towards the rear. In the case of a geometric embodiment of this kind, it is possible for tensile forces that act on the C-profile orthogonally away from the exposed surface to be converted, at least in part, into forces that act as compression forces within the covering concrete, owing to the surface of the C-profile that extends in an inclined manner. Concrete can with stand compression forces of this kind far better than tensile forces.

According to an embodiment, the profile is formed as a sheet metal profile.

In other words, the C-shaped profile may be formed of metal, in particular of steel. A profile of this kind may for example be stamped out of a metal sheet and/or appropriately bent into shape. Alternatively, the profile may also be pultruded. In this case, a material thickness may be adapted to the forces to be absorbed, and may be for example between 0.5 mm and 5 mm. Surfaces of the profile may be provided with a coating, for example as corrosion protection. The coating may for example be applied galvanically. A metal profile can withstand high loads and can be produced and/or worked in a simple and cost-effective manner. Alternatively, the profile may also be rolled. In the case of said rolling, a continuous strip of the corresponding material is made into the final shape thereof by means of a plurality of longitudinally arranged rollers.

According to another embodiment, the profile is formed as a plastics profile.

In other words, the C-shaped profile may be produced as a plastics part. For example, the profile may be extruded or injection-molded. Possible materials are in particular loadable plastics materials and/or easily workable plastics materials such as ABS (acrylonitrile butadiene styrene). Plastics profiles can withstand without problem the loads that occur in particular in some elevator applications, and can be produced and/or worked in a particularly simple and cost-effective manner.

According to an embodiment, a front portion of the profile adjoins the exposed surface of the second concrete region, and an opposing rear portion of the profile adjoins the reinforcement that is received in the first concrete region.

In other words, the profile may extend over the entire depth of the second concrete region, i.e. from the exposed surface as far as the first concrete region that is strengthened by the reinforcement.

According to an embodiment of the production method proposed herein, a design and arrangement of the profile of this kind can occur in particular if the C-profile is mounted between the reinforcement and sub-regions of the cladding prior to casting, using concrete as a spacer.

In other words, the C-profile may be used to keep the wall defining the cladding at a desired spacing from the reinforcement in the first concrete region while the concrete is being cast, in order to form the second concrete region therebetween. In conventional concrete engineering, specifically dimensioned spacers are generally used to keep the cladding at a minimum spacing of for example approximately 3 cm from the reinforcement, in order to ensure that the concrete covers the reinforcement in a sufficient thickness and can reliably protect said reinforcement from corrosion. When producing an embodiment of the wall proposed herein, at least some of said conventionally used spacers can be replaced by a C-profile having corresponding depth dimensions, which C-profile can then be used in the finished wall as a wall securing assembly.

According to an embodiment, textile regions and/or webs consisting of flexible metal wires are attached to the C-profile, which textile regions and/or webs are flexural prior to being embedded in the second concrete region.

In other words, although no backwardly projecting rigid anchor regions are intended to be provided on the C-profile in order that the C-profile can be pushed into the second concrete region without problem and without colliding with the reinforcements in the first concrete region, flexible anchor regions in the form of flexural textile regions may be provided on the C-profile. Textile regions of this kind may consist of textile fibers for example. The textile fibers may for example be carbon fibers, glass fibers, aramid fibers, metal fibers or the like. The textile fibers may protrude from the C-profile, individually or in bundles or in a manner interconnected as a web or a knitted fabric. Provided that they are not embedded in the concrete, the textile fibers are flexibly movable, such that they can bend to the side in a resiliently yielding manner in the event of collisions with reinforcements, and not prevent the C-profile from moving relative to the reinforcements, for example when the C-profile is intended to be inserted between the first concrete region and a cladding. However, if they are embedded in the concrete and said concrete is rigidified, the textile fibers or webs consisting of flexible metal wires can ensure additional anchoring of the C-profile.

According to an embodiment, the wall is formed as the wall of an elevator shaft and the profile extends over substantially the entire height of elevator shaft, preferably vertically.

As mentioned above, a wall set out herein may be particularly advantageous if it is formed as an elevator shaft wall and is designed to be able to secure additional components of an elevator system in the elevator shaft in an advantageous manner. In this case it may be advantageous to allow the C-profile to extend over the entire height or at least substantial portions of the height of the elevator shaft in order that additional parts can be secured to the elevator shaft at any positions over the height thereof. In this context "substantially the entire height" can be understood to mean that at least those regions of the elevator shaft along which the elevator car and/or the counterweight can be moved, i.e. for example from a bottom edge of a lowest story as far as a top edge of a highest story. In this case, the C-profile may be entirely continuous. Alternatively, the C-profile may be assembled from a plurality of segments which may be interconnected so as to be directly adjacent to one another or in a manner having intermediate pieces therebetween.

According to an embodiment, a holding console for holding a guide rail for a displaceable elevator component that is displaceable along a displacement path that is delimited by the wall is secured to the wall securing assembly by a securing means that engages in the C-profile.

In other words, in this specific embodiment the wall securing assembly is intended to be designed specifically in order to be able to secure a guide rail, along which for example an elevator car or a counterweight can be moved in a guided manner, to the elevator shaft wall. In this case, the guide rail is intended to be fixed to the wall securing assembly by means of a holding console.

The holding console may be designed in a manner similar to the holding consoles (sometimes also referred to as "brackets") conventionally used in elevator shafts for securing guide rails. Said holding console may for example be a stable sheet metal part which is designed both to cooperate with the guide rail and also to cooperate with the remaining elements of the wall securing assembly.

The holding console may be secured to the C-profile using a securing means. The securing means may for example interlockingly engage in the C-profile. In particular, the securing means may for example comprise a threaded bolt or a screw, one end of which can engage on the holding console and the opposing end of which can be screwed into a mating part received in the C-profile. The mating part may be interlockingly received in the C-profile.

The guide rail may be an elongated rail having a for example T-shaped cross-section. A horizontal limb of the "T" may be held on the holding console, and the preferably vertical limb of the "T" may protrude as far as the displaceable elevator component. Guide shoes, for example comprising rollers, may be provided on the displaceable elevator component, by means of which guide shoes the elevator component can roll along the limb of the "T" and thus be supported on the guide rail. A particularity of a T-shaped rail of this kind is inter alia that the forces acting on the substantially vertical limb can always act only as compression forces, i.e. in parallel with the limb, towards the horizontal limb, or as flexural forces, i.e. transversely to the limb, but not as tensile forces, i.e. in parallel with the limb, away from the horizontal limb. The rail is therefore generally loaded only under compression, but at most slightly under tension. Accordingly, said rails exert at most low tensile forces on the C-profile of the wall securing assembly received in the wall.

According to an embodiment, in the case of the production method proposed herein, an opening of the C-profile is temporarily sealed against penetration of concrete during grouting of the first and the second concrete region using concrete.

In other words, the opening via which an internal volume of the C-profile is connected to the surroundings and through which for example a securing element can engage in the C-profile can be sealed, while casting the C-profile in the concrete, at least in such a way that no concrete can flow into the internal volume. It is thereby possible to prevent hardened concrete from blocking the internal volume and preventing engagement of the securing element, and thus needing to be laboriously removed. In this case, the sealing of the opening is intended to be temporary, such that the opening can be exposed without problem and preferably without tools or using only a simple tool, after the concrete has hardened. For example, the opening may be temporarily covered by adhesive tape. Alternatively, a C-profile consisting of plastics material can first be manufactured, for example extruded or injection-molded, such that the opening is initially not yet formed, but instead is first provided only as a type of "predetermined breaking point" having particularly thin material and can then be exposed, i.e. cut away, locally or over the entire length of the C-profile after the concrete has hardened.

It is noted that some of the possible features and advantages of the invention are described herein in part with reference to a wall provided with a wall securing assembly and in part with reference to a method for producing a wall of this kind. A person skilled in the art will recognize that the features can be transferred, combined, adapted or exchanged in an appropriate manner in order to arrive at further embodiments of the invention.

Embodiments of the invention will be described in the following with reference to the accompanying drawings, neither the drawings nor the description being intended to be interpreted as limiting the invention.

The figures are merely schematic and are not to scale. Identical reference signs in the different figures denote identical or functionally identical features.

DETAILED DESCRIPTION

Figure 1:
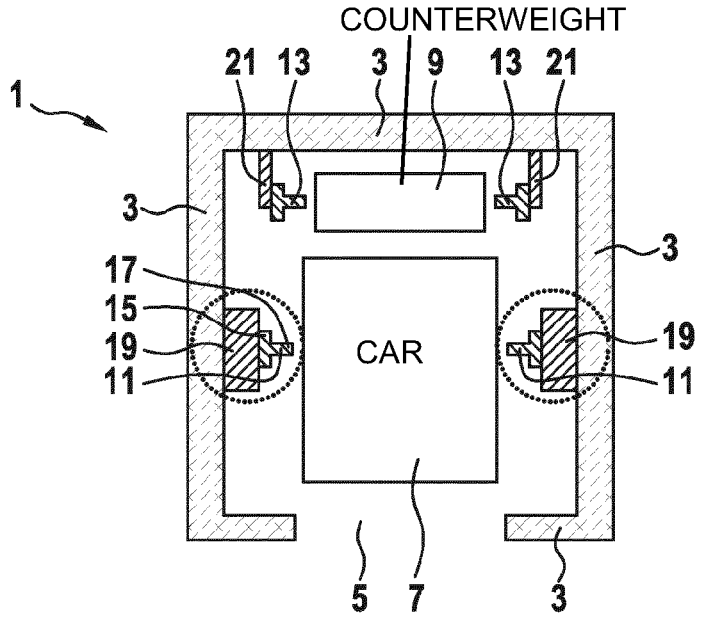
Fig. 1 (Prior Art)
FIG. 1 is a horizontal sectional view of an elevator shaft comprising guide rails secured therein.

FIG. 1 is a horizontal sectional view through an elevator shaft 1. The elevator shaft 1 is delimited laterally by walls 3. A shaft opening 5 for an elevator shaft door (not shown) is provided in a front wall 3.

An elevator car 7 and a counterweight 9 can be displaced in the vertical direction within the elevator shaft 1. In order to prevent the elevator car 7 and/or the counterweight 9 also moving in the horizontal direction in the process, i.e. for example oscillating to and fro in an uncontrolled manner within the elevator shaft 1, said displaceable components 7, 9 are guided in the vertical direction, along guide rails 11, 13 arranged in a stationary manner within the elevator shaft 1.

In this case, the guide rails 11, 13 are T-shaped in cross-section. An example of a guide rail is described in DE 299 03 407 U1. A horizontal limb of the "T" of the T-shaped guide rail is also referred to as a rail base 15, a limb that protrudes centrally therefrom is also referred to as a guide limb 17. Guide shoes (not shown) are attached to the elevator car 7 and to the counterweight 9. An example of a guide shoe and the guidance thereof on a guide rail is described in EP 1 897 834 A1. Rollers or sliding bearings may be provided on the guide shoe, which rollers or bearings can roll or slide along the opposing lateral faces and the end face of the guide limb 17 and thus guide the guide shoe and the displaceable component 5, 7 attached thereto in the vertical direction.

Conventionally, the guide rails 11, 13 are secured to the walls 3 of the elevator shaft 1 by means of specialized holding consoles 19, 21. The holding consoles 19, 21 are generally designed such that they can ensure reliable mechanical attachment of the guide rails 11, 13 to the relevant wall 3, as well as transmission of the forces acting on the guide rails 11, 13 to the wall 3. The holding consoles 19, 21, in turn, are secured to the walls 3 by means of suitable C-shaped profiles (not shown in FIG. 1).

As a wall securing assembly, conventionally holes have usually been drilled in the walls 3 at suitable positions and then screws or bolts anchored therein, in order to be able to then secure the holding consoles 19, 21 thereto. Alternatively, suitable anchor profiles have already been positioned at previously determined positions when casting the concrete wall 3 and integrally cast into the concrete, such that the holding consoles 19, 21 could in turn then be secured to said anchor profiles.

Figure 2:
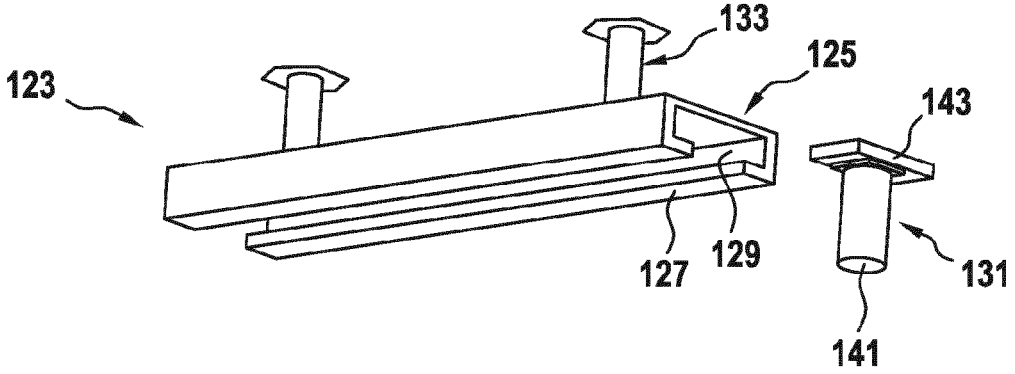
Fig. 2 (Prior Art)
FIG. 2 is a perspective view of a conventional anchor profile that comprises rigid anchor projections and is to be arranged horizontally in a wall.
Figure 3:
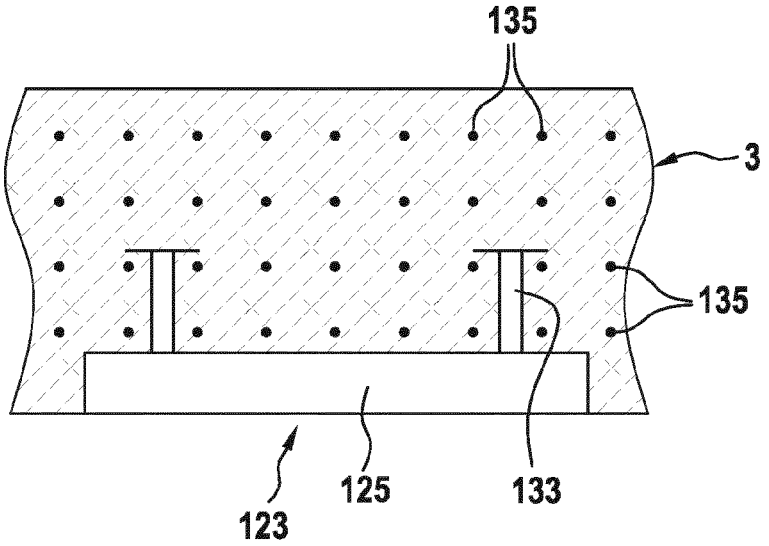
Fig. 3 (Prior Art)
FIG. 3 is a horizontal sectional view of a wall comprising a conventional anchor profile anchored therein.

FIG. 2 shows an example of a conventional anchor profile 123. FIG. 3 illustrates the way in which an anchor profile 123 of this kind can be cast so as to be anchored in a wall 3.

The anchor profile 123 conventionally has a C-shaped profile 125. Said C-shaped profile 125 comprises a continuous slot 127 on one side. A securing element 131, for example in the form of a securing bolt 141 comprising a securing plate 143 that engages behind the C-profile 125 on the inside, can be inserted into an internal volume 129 of the C-shaped profile 125 and can thus be anchored therein so as to be loadable under tension.

In order to be able to anchor the anchor profile 123 within the wall 3 so as to be rigidly anchored and also loadable under tension, rigid anchor elements 133 are provided on the anchor profile 123. Just like the C-shaped profile 125, said anchor elements 133 usually consist of metal, for example in the form of solid bolts, and protrude from the C-shaped profile 125, in particular from the rear surface thereof, in a direction away from the rear surface. In this case, a length of the anchor elements 133 is usually of a similar dimension to or greater than a depth of the C-shaped profile 125. The anchor elements 133 of the anchor profile 123 can thus extend deep into the inside of the concrete wall 3 and can engage therein, in particular between reinforcements 135 introduced into the concrete wall 3, or even engage behind said reinforcements.

As a result, the anchor profiles 123 are stable and are fixed in the concrete wall 3 so as to be loadable under high tension. However, attaching the anchor profiles 123 at the specified positions on the reinforcement 135 is often difficult and/or associated with significant outlay, in particular if the reinforcement 135 is formed as a complex structure comprising vertical and horizontal struts or similar components that mutually intersect in part. In this case, the anchor profiles 123 are conventionally integrated into the concrete wall 3 in the horizontal direction.

Figure 4:
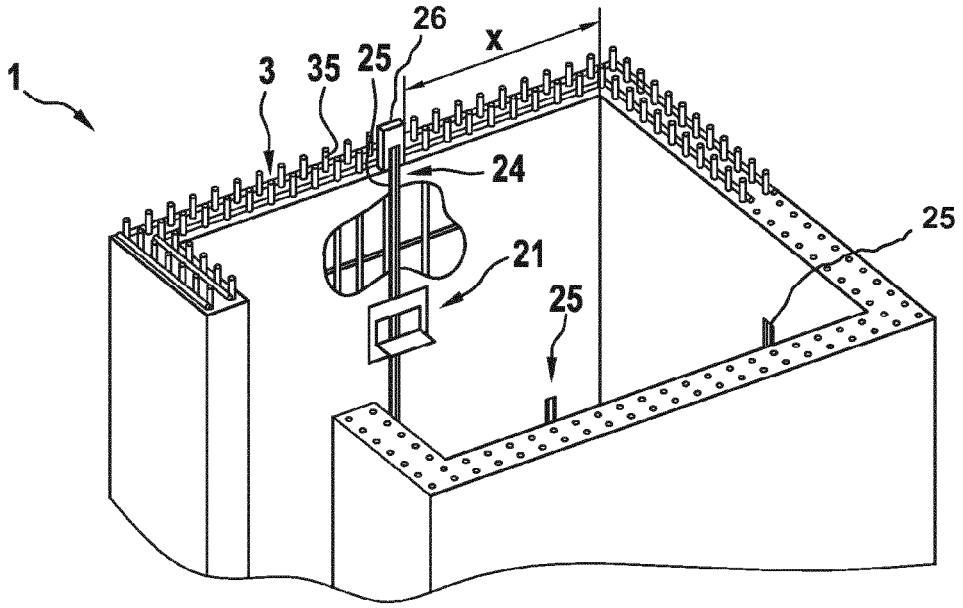
FIG. 4 is a perspective view of an elevator shaft comprising walls having wall securing assemblies arranged therein, according to an embodiment of the present invention.

FIG. 4 shows an elevator shaft 1 comprising walls 3 in which planar C-shaped profiles 25 are integrated close to the surface as part of the wall securing assemblies 24. In this case, the C-shaped profiles 25 are arranged in a vertical orientation within the elevator shaft 1 and extend substantially along the entire length of the elevator shaft 1. Optionally, some segments of the C-profile 25 may be interconnected using coupling units 26.

In this case, each C-profile 25 is already integrally cast into a concrete layer covering a reinforcement 35 during production of the wall 3, i.e. during casting of the concrete that forms the wall 3. Each C-profile 25 can for example be arranged at a specified spacing x from an edge of the wall 3 or from a transition to an adjacent wall 3, prior to casting. Since in this case the specified spacing x is relatively short, for example is only a few meters, the C-profiles 25 can be arranged at desired positions within the elevator shaft 1 in a simple manner and with a high degree of accuracy.

Figure 5:
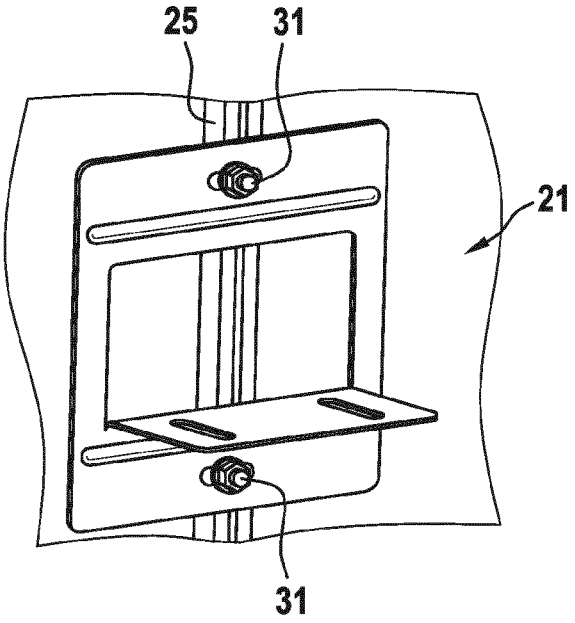
FIG. 5 is an enlarged view of a detail marked in FIG. 4.

As shown in an enlarged view in FIG. 5, holding consoles 21 can subsequently be secured to the cast C-profiles 25. For example, holding consoles 21 of this kind can be integrally fixed into securing elements 31 that engage in the C-profiles 25. In this case, the holding consoles 21 can be designed for example in the form of stamped and bent metal sheets, in a similar way to holding consoles or brackets conventionally used in elevator construction.

Figure 6:
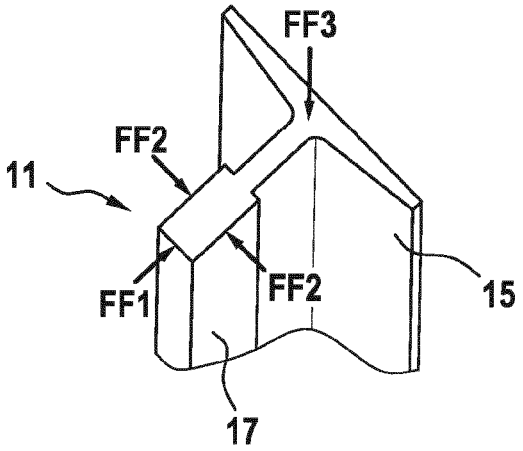
FIG. 6 is a perspective view of a guide rail for an elevator system.

Guide rails 11, as are shown by way of example in FIG. 6, can then be secured to holding consoles 21 of this kind. In this case, the rail base 15 is secured to the holding console 21 such that the guide limb 17 is fixed to the displaceable components 7, 9, to be guided, so as to be transverse to the wall 3. The forces FF1, FF2, FF3 exerted on the guide rail 11 by the guide shoes of the displaceable components 7, 9 to be guided are shown symbolically. In this case, it should be noted that compression forces FF1 act in the direction of the rail base 15 and thrust FF2 acts on the guide rail 11 transversely to said compression forces FF1 in each case. Furthermore, axial forces FF3 arise in parallel with the extension direction of the guide rail 11, for example when the structure provided with the guide rail 11 sinks over time. However, in general no significant tensile forces are exerted on the guide limb 17 of the guide rail 11.

The fact that no or at most small tensile forces, brought about indirectly by the possible thrust FF2, are exerted on the securing means in the wall 3 by the guide rail 11 can be made use of in an advantageous manner for the type of design of the wall securing assembly 24 proposed herein.

Figure 7:
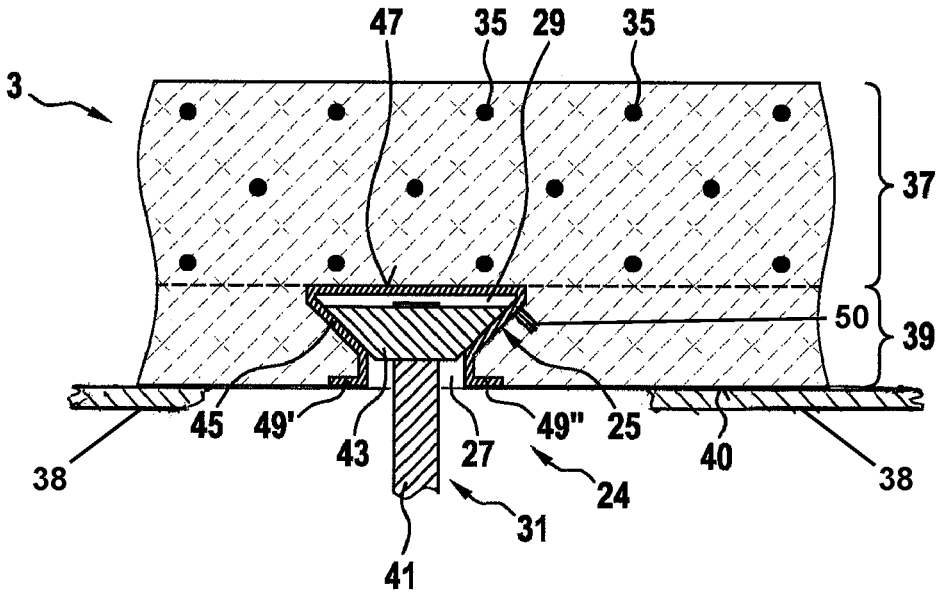
FIG. 7 is a horizontal side view of a wall securing assembly in the form of a C-profile according to an embodiment of the present invention.

FIG. 7 is a cross-sectional view of a wall securing assembly 24 in a wall 3. The wall securing assembly 24 comprises a first concrete region 37 and a second concrete region 39. A plurality of reinforcements 35 is received in the first concrete region 37. In this case, the reinforcements 35 can extend in various directions, for example longitudinally and/or transversely, within the first concrete region 37. No reinforcements are provided in the second concrete region 39. Instead, said second concrete region 39 is provided merely as a relatively thin covering of the first concrete region 37 in order to protect the reinforcements 35 of said first concrete region from corrosion for example. A cladding 38 is used during the concrete grouting of the first and second regions 37, 39 and then removed.

In this case, the wall securing assembly 24 is formed having a C-shaped profile 25 which is embedded solely into the second concrete region 39 but does not extend into the first concrete region 37. In particular, the C-profile does not comprise any rigid anchor elements 133, as is the case in the conventional anchor profile in FIG. 2. As an option, textile regions and/or webs 50 consisting of flexible metal wires are attached to the C-shaped profile 25, which textile regions and/or webs are flexural prior to being embedded in the second concrete region 39.

Figure 8:
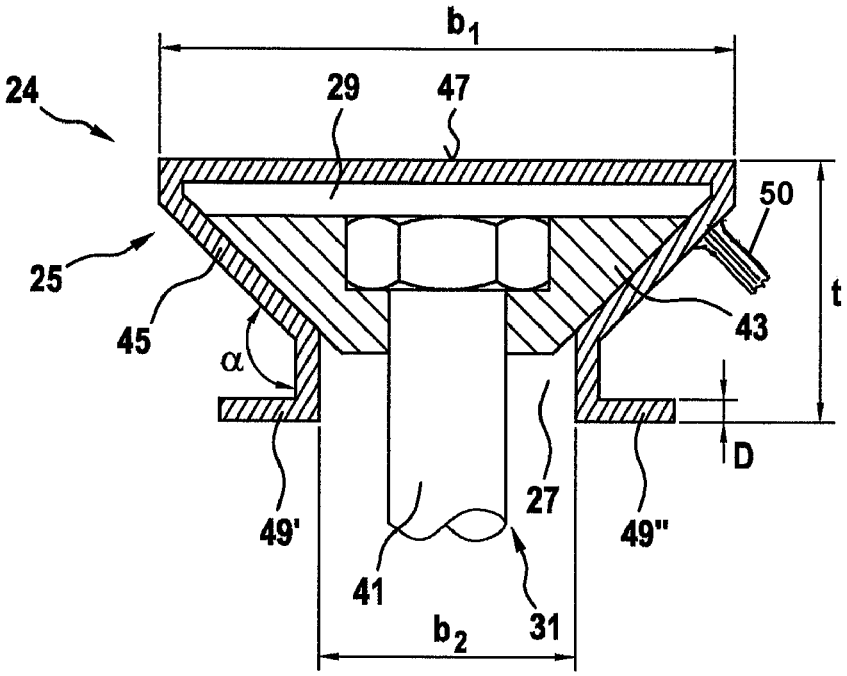
FIG. 8 shows dimensions, by way of example, of a C-profile for a wall according to an embodiment of the present invention.

FIG. 8 shows an enlargement of the C-profile 25 of the wall securing assembly 24. The C-profile 25 may be formed as a sheet metal part, for example as an extruded component or as a bent sheet. Alternatively, the C-profile 25 may be a plastics component which may be extruded or injection-molded or rolled for example. In this case, the material thickness D can be selected in a manner suitable for the required mechanical stability, and may for example be between 1 and 5 mm, preferably approximately 2 mm.

The C-profile 25 may comprise a front flange 49', 49", by means of which said profile can for example end flush with the free surface 40 of the wall 3. The slot-like opening 27 extends towards the internal volume 29, centrally between two flange parts 49', 49". Inclined flanks 45 of the C-profile extend adjacently to the flange parts 49', 49" in each case. In this case, each of said flanks 45 extends so as to be spaced apart from the exposed surface 40 of the wall 3 and is oriented towards said exposed surface and is inclined relative thereto. The C-profile 25 therefore widens conically towards the rear, proceeding from the flange parts 49', 49" arranged on the exposed surface 40 towards an opposing side 47. A maximum width $b_1$ on the rear surface 47 of the C-profile can typically be between 30 and 100 mm, for example approximately 60 mm. A narrower width $b_2$ in the region of the openings 27 between the two flange parts 49', 49" may be approximately half the maximum width $b_1$ and can typically be between 15 and 50 mm, for example approximately 30 mm. A depth t of the C-profile 25 is intended to be at most equal to a depth of the covering second concrete layer 39 and should for example be less than 30 mm, preferably less than 25 mm.

A conical design of this kind can provide at least two advantages: firstly, the C-profile 25 can be received in the second concrete region 39 in an interlockingly undercut manner, i.e. sub-regions of the second concrete region 39 can cover the C-profile 25 and thus prevent the C-profile 45 being able to be pulled out of the wall. Secondly, the conical geometry of the C-profile 25 can contribute to the C-profile 25 also being able to withstand relatively high tensile forces, of for example up to 6 kN, but at least the usually only low tensile forces of less than 2 kN that are typical in elevator applications when securing guide rails, despite said C-profile not being anchored to the reinforcement 35. In this case, advantageous use can be made of the fact that tensile forces, i.e. forces acting orthogonally to the exposed surface 40, that act on the C-profile 25 are deflected at least in part as compression forces acting within the concrete of the second concrete region 39, owing to the inclination of the flanks 45 of for example an angle $\alpha$=135°, and concrete can withstand compression forces of this kind very well.

A securing plate 43 of the securing element 31 is received in the internal volume 29 of the C-profile 25. A cross-section of said securing plate 43 is also conical, in a manner complementary to the conical cross-section of the C-profile, such that the side flanks of the securing plate 43 rest on the inclined side flanks 45 of the C-profile 25 and can be supported thereon. The securing element 31 further comprises a securing bolt 41 that cooperates with the securing plate 43, i.e. for example is screwed therein, and to which for example the holding console 21 can be secured.

It has been found that in particular the tensile forces acting on a guide rail 11 in an elevator shaft 1 are very low and it may therefore be acceptable to secure the guide rail 11 to a C-shaped profile 25 which is cast solely into the layer of the second concrete region 39 that covers a reinforcement 35. The anchor element-free C-shaped profile 25 can be arranged vertically in the wall 3 in a simple manner, such that holding consoles 21 which hold the guide rail 11 can be secured to said profile at any height.

In addition to the holding consoles 21 and the guide rails 11 attached thereto, other additional components such as lights, batteries, converters etc. to be secured in the elevator shaft 1, can also be secured to the C-profile 25.

Finally, it should be noted that terms such as "having", "comprising", etc. do not exclude any other elements or steps, and terms such as "one" or "a" do not exclude a plurality. Furthermore, it should be noted that features or steps that have been described with reference to one of the above embodiments can also be used in combination with other features or steps of other embodiments described above.

In accordance with the provisions of the patent statutes, the present invention has been described in what is considered to represent its preferred embodiment. However, it should be noted that the invention can be practiced otherwise than as specifically illustrated and described without departing from its spirit or scope.

LIST OF REFERENCE SIGNS

1 elevator shaft
3 wall
5 shaft opening
7 elevator car
9 counterweight
11 guide rail
13 guide rail
15 rail base
17 guide limb
19 holding console
21 holding console
24 wall securing assembly
25 C-shaped profile
26 coupling unit
27 opening
29 internal volume
31 securing element
35 reinforcement
37 first concrete region
38 cladding
39 second concrete region
40 exposed surface
41 securing bolt
43 securing plate
45 inclined flank of the C-profile
47 rear face of the C-profile
49' flange part
49" flange part
50 textile regions
123 anchor profile
125 C-shaped profile
127 opening
129 internal volume
131 securing element
133 anchor element
135 reinforcement
141 securing bolt
143 securing plate
$\alpha$ angle
$b_1$ maximum width
$b_2$ narrower width
D material thickness
FF1 force
FF2 force
FF3 force
t depth
x spacing

The invention claimed is:

1. A wall securing assembly for securing an elevator component to an elevator shaft wall in an elevator shaft, the wall securing assembly comprising:

a first concrete region of the elevator shaft wall that is strengthened by reinforcements;

a second concrete region of the elevator shaft wall that is not strengthened by reinforcements, covers the first concrete region and includes a surface that is exposed to surroundings in the elevator shaft;

an elongated profile that is C-shaped in cross-section; and wherein the profile is embedded solely into the second concrete region and is oriented in a main extension direction of the elevator shaft, wherein the C-shaped profile extends vertically in the elevator shaft wall over substantially an entire height of the elevator shaft.

2. The wall securing assembly according to claim 1 wherein the elevator component is a guide rail secured to the C-shaped profile.

3. The wall securing assembly according to claim 1 wherein the C-shaped profile does not include any rigid anchor elements that protrude in a direction away from a rear surface of the C-shaped profile.

4. The wall securing assembly according to claim 1 wherein the C-shaped profile is received in the second concrete region in an interlockingly undercut manner.

5. The wall securing assembly according to claim 1 wherein at least one flank of the C-shaped profile is oriented towards the exposed surface of the second concrete region and is arranged inclined relative to the exposed surface.

6. The wall securing assembly according to claim 1 wherein the C-shaped profile has a depth, measured in a direction orthogonal to the exposed surface of the second concrete region, not exceeding 30 mm.

7. The wall securing assembly according to claim 1 wherein the C-shaped profile is formed as a sheet metal profile.

8. The wall securing assembly according to claim 1 wherein the C-shaped profile is formed as a plastics profile.

9. The wall securing assembly according to claim 1 wherein a front portion of the C-shaped profile adjoins the exposed surface of the second concrete region, and wherein an opposing rear portion of the C-shaped profile adjoins at least one of the reinforcements in the first concrete region.

10. The wall securing assembly according to claim 1 wherein at least one textile region is attached to the C-shaped profile, the textile region consisting of a plurality of flexible metal wires that are flexural prior to being embedded in the second concrete region, the flexible metal wires extending from the C-shaped profile at least one of individually, as a bundle and as a web.

11. The wall securing assembly according to claim 1 including a holding console for holding a guide rail as the elevator component, the holding console being secured to the wall securing assembly by a securing element that engages in the C-shaped profile.

12. The wall securing assembly according to claim 11 wherein the securing element includes a securing bolt having one end adapted to engage the holding console and an opposing end adapted to be screwed into a securing plate received in the C-shaped profile.

13. The wall securing assembly according to claim 12 wherein the securing plate is adapted to be interlockingly received in the C-shaped profile.

14. A method for securing elevator components to an elevator shaft wall in an elevator shaft using the wall securing assembly according to claim 1, the method comprising the steps of:

attaching at least one holding console to the C-shaped profile at a selected height in the elevator shaft, the at least holding console adapted to hold a guide rail as one of the elevator components.

15. The method according to claim 14 including securing the at least one holding console with a securing element that engages in the C-shaped profile.

16. A wall of an elevator shaft including a wall securing assembly comprising:

a first concrete region of the wall that is strengthened by reinforcements;

a second concrete region of the wall that is not strengthened by reinforcements, covers the first concrete region and includes a surface that is exposed to surroundings in the elevator shaft; and an elongated profile that is C-shaped in cross-section and is embedded solely into the second concrete region, the C-shaped profile being oriented in a main extension direction of the elevator shaft and extending vertically in the wall over substantially an entire height of the elevator shaft, the C-shaped profile adapted for securing an elevator component to the wall.

17. The wall according to claim 16 including a holding console for holding an elevator guide rail as the elevator component secured to the wall securing assembly by engaging the C-shaped profile.

* * * * *